US005377750A

United States Patent [19]

Arterbury et al.

[11] Patent Number: 5,377,750

[45] Date of Patent: * Jan. 3, 1995

[54] SAND SCREEN COMPLETION

[75] Inventors: Bryant A. Arterbury, Houston; Henry L. Restarick, Plano; James E. Spangler, Spring, all of Tex.

[73] Assignee: Halliburton Company, Houston, Tex.

[ * ] Notice: The portion of the term of this patent subsequent to Mar. 22, 2011 has been disclaimed.

[21] Appl. No.: 34,010

[22] Filed: Mar. 22, 1993

Related U.S. Application Data

[63] Continuation-in-part of Ser. No. 921,922, Jul. 29, 1992, Pat. No. 5,295,538.

[51] Int. Cl.[6] ..... E21B 43/08; E21B 43/10; E21B 43/12

[52] U.S. Cl. ..... 166/205; 166/147; 166/157; 166/228; 210/510.1

[58] Field of Search ..... 166/74, 157, 158, 205, 166/51, 227, 228, 229, 236, 115, 116, 147; 210/510.1

[56] References Cited

U.S. PATENT DOCUMENTS

| | | | |
|---|---|---|---|
| 1,874,035 | 8/1932 | Fletcher | 166/228 |
| 2,139,975 | 12/1938 | Utt | 166/158 |
| 2,335,558 | 11/1943 | Young | 166/5 |
| 2,554,343 | 5/1951 | Pall | 210/205 |
| 2,600,150 | 6/1952 | Abendroth | 166/5 |
| 2,611,750 | 9/1952 | White | 210/510.1 |
| 2,673,614 | 3/1954 | Miller | 166/12 |
| 2,819,209 | 1/1958 | Pall et al. | 210/510.1 |
| 2,826,805 | 3/1958 | Probst et al. | 29/182 |
| 2,871,947 | 2/1959 | Fredd | 166/219 |
| 2,902,096 | 9/1959 | Stewart | 166/228 |
| 2,927,640 | 3/1960 | Kenneday | 166/205 X |
| 2,963,163 | 12/1960 | Veres | 210/496 |
| 3,033,783 | 5/1962 | Lubben | 210/510 |
| 3,201,858 | 8/1965 | Valyi | 29/157.3 |
| 3,313,621 | 4/1967 | Mott, III | 75/12 |
| 3,437,135 | 4/1969 | Cox et al. | 166/229 X |
| 3,567,437 | 3/1971 | Mott | 75/214 |
| 3,605,245 | 9/1971 | Zapf | 29/420.5 |
| 3,632,243 | 1/1972 | Mott | 425/78 |
| 3,746,642 | 7/1973 | Bergstrom | 210/446 |
| 3,785,038 | 1/1974 | Zapf | 29/420.5 |
| 3,785,409 | 1/1974 | Smith, III | 140/92.2 |

(List continued on next page.)

FOREIGN PATENT DOCUMENTS

| | | | |
|---|---|---|---|
| 360678 | 11/1938 | Italy | 166/205 |
| 11247 | 3/1982 | Japan | 210/510.1 |

OTHER PUBLICATIONS

The Pall Porous Metals Filter Guide, Pall Trinity Micro Corp., Sep. 1978.

*Primary Examiner*—Hoang C. Dang
*Attorney, Agent, or Firm*—Tracy W. Druce; Mason M. Campbell

[57] ABSTRACT

A sand screen having a plurality of sintered, substantially spherical plastic members covering a perforated mandrel is releasably suspended from a packer mandrel by a locking mandrel and a landing nipple. The sand screen and locking mandrel are retrievable with the assistance of a running tool which is insertable into the bore of the locking mandrel. According to this arrangement, the sand screen can be removed and replaced without retrieving the packer or the production tubing. In one embodiment, the sand screen is enclosed within the bore of a sliding side valve. The sliding side valve can be opened and closed as desired for selectively admitting production from various producing zones, or for isolation of a damaged screen. In another embodiment, an auxiliary sand screen having a plurality of sintered, substantially spherical plastic members covering a perforated mandrel is inserted into the bore of a primary screen, for example, a conventional wire-wrap sand screen. The auxiliary sand screen is thus interposed in the flow path for screening out sand fines which may be conducted through the wire-wrap screen because of screen damage caused by corrosion or sand erosion.

15 Claims, 6 Drawing Sheets

U.S. PATENT DOCUMENTS

| | | | |
|---|---|---|---|
| 3,897,531 | 7/1975 | Overhoff et al. | 264/109 |
| 3,908,256 | 9/1975 | Smith, III | 29/163.5 CW |
| 3,958,634 | 5/1976 | Smith, III | 166/233 |
| 3,997,006 | 12/1976 | Wetzel | 166/227 X |
| 4,063,603 | 12/1977 | Rayborn | 175/65 |
| 4,071,937 | 2/1978 | Rohlig | 29/420 |
| 4,072,616 | 2/1978 | Rohlig | 210/493 R |
| 4,088,580 | 5/1978 | Spurlock | 210/323 T |
| 4,186,100 | 1/1980 | Mott | 210/496 |
| 4,217,141 | 8/1980 | Schrittwieser | 75/244 |
| 4,254,832 | 3/1981 | Patton et al. | 166/147 X |
| 4,343,358 | 8/1982 | Gryskiewicz | 166/227 |
| 4,406,326 | 9/1983 | Wagner | 166/227 |
| 4,483,820 | 11/1984 | Scheib | 419/28 |
| 4,583,594 | 4/1986 | Kojicic | 166/228 |
| 4,681,161 | 7/1987 | Arterbury et al. | 166/227 |
| 4,705,611 | 11/1987 | Grimes et al. | 204/129.1 |
| 4,755,265 | 7/1988 | Young | 204/45.1 |
| 4,811,790 | 3/1989 | Jennings, Jr. et al. | 166/278 |
| 4,821,800 | 4/1989 | Scott et al. | 166/278 |
| 4,825,944 | 5/1989 | Mays | 166/51 |
| 4,856,590 | 8/1989 | Caillier | 166/51 X |
| 4,856,591 | 8/1988 | Donovan et al. | 166/278 |
| 4,858,691 | 8/1989 | Ilfrey et al. | 166/278 |
| 4,860,831 | 8/1989 | Caillier | 166/158 X |
| 4,917,183 | 4/1990 | Gaidry et al. | 166/278 |
| 5,004,049 | 4/1991 | Arterbury | 166/228 |
| 5,088,554 | 2/1992 | Arterbury et al. | 166/228 |

SAND SCREEN COMPLETION

CROSS REFERENCE TO RELATED APPLICATION

This application is a continuation-in-part of co-pending U.S. application Ser. No. 07/921,922 filed on Jul. 29, 1992, now the U.S. Pat. No. 5,295,538.

FIELD OF THE INVENTION

This invention relates generally to well completion apparatus, and in particular to method and apparatus for suspending a sand screen in a well bore.

BACKGROUND OF THE INVENTION

In the course of completing an oil and/or gas well, it is common practice to run a string of casing into the well bore and then to run the production tubing inside the casing. At the site of the producing formation, the casing is perforated across one or more production zones to allow production fluids to enter the casing bore. After the well is completed and placed in production, formation sand from unconsolidated formations may be swept into the flow path along with formation fluid, which erodes production components. This sand is relatively fine and erodes production components in the flow path. In some completions, however, the well bore is uncased, and an open face is established across the oil or gas bearing zone. Such open bore hole arrangements are utilized, for example, in water wells, test wells and horizontal well completions. Similarly, after the well is completed and placed in production, formation sand from unconsolidated formations may also be swept into the flow path along with formation fluid.

With either cased or uncased well bores, one or more sand screens may be installed in the flow path between the production tubing and the perforated casing. A packer may be set above and below the sand screen to seal off the annulus in the producing zone from non-producing formations. The annulus around the screen may be packed with a relatively coarse sand or gravel which acts as a filter to reduce the amount of fine formation sand reaching the screen.

Conventionally, sand screens employ a perforated mandrel which is surrounded by longitudinally extending spacer bars, rods or ribs and over which a continuous wire is wrapped in a carefully spaced helical configuration to provide a predetermined longitudinal gap between the wire turns. See for example, U.S. Pat. No. 3,785,409; U.S. Pat. No. 3,958,634; and U.S. Pat. No. 3,908,256. The aperture between turns permits formation fluids to flow through the screen, while the closely spaced wire turns exclude fine particulate materials such as sand or gravel which may penetrate the gravel pack.

However, during the initial production period following the gravel packing operation, fine sand may be carried through the gravel pack before the gravel pack bridge stabilizes and yields clean production. Those fines tend to migrate through the gravel pack and screen and lodge within the inner annulus between the outer wire wrap and the perforated mandrel. In some instances, this can cause severe erosion of the screen and ultimate failure of the screen.

One attempt to overcome the sand erosion problem is to interpose a prepack of gravel within the annulus between the inner mandrel and the outer wire screen. The prepacked gravel is sized appropriately to exclude the fines which accompany the formation fluid. Raw gravel, as well as epoxy resin coated gravel, have been used extensively in prepacked well screens. However, the sand erosion problem has not entirely been alleviated, and erosion continues to remain a problem in some instances.

OBJECTS OF THE INVENTION

It is possible that after a sand screen has been installed in a well for a period of time, its structural integrity may be compromised by corrosion or sand erosion, in which case it may be necessary to repair, replace or isolate the damaged screen. Accordingly, the principal object of the present invention is to provide an improved method for installing a sand screen having a sintered, substantially spherical plastic bead prepack body sandwiched between an outer screen and an inner production mandrel in a well bore so that it can be retrieved for repair or replacement without retrieving the packer.

A related object of the present invention is to provide method and apparatus for selectively isolating a damaged sand screen.

Another object of the present invention is to provide method and apparatus for installing a sand screen having a sintered, substantially spherical plastic bead prepack body sandwiched between an outer screen and an inner production mandrel in combination with a damaged wire-wrap screen so that screened production can continue without removal of the damaged wire-wrap screen.

Yet another object of the present invention is to provide method and apparatus for installing an auxiliary sand screen having a sintered, substantially spherical plastic bead prepack body sandwiched between an outer screen and an inner production mandrel in combination with a damaged primary screen having a sintered, substantially spherical plastic bead prepack body sandwiched between an outer screen and an inner production mandrel so that screened production can continue without removal of the damaged sand screen.

SUMMARY OF THE INVENTION

According to a first embodiment of the invention, a sand screen having a sintered, substantially spherical plastic bead prepack body sandwiched between an outer screen and an inner production mandrel is releasably suspended from a packer mandrel by a locking mandrel and a landing nipple. In this arrangement, the landing nipple is attached to the lower end of the packer mandrel, and a screen having a sintered, substantially spherical plastic bead prepack body sandwiched between an outer screen and an inner production mandrel is attached to the lower end of the locking mandrel. The locking mandrel is disposed in releasable, interlocking engagement with the landing nipple. The sand screen and lock mandrel are retrievable with the assistance of a running tool which is insertable into the bore of the locking mandrel. Thus the sand screen may be removed and replaced without retrieving the packer or the production tubing.

In a second embodiment, the sand screen having a sintered, substantially spherical plastic bead prepack body sandwiched between an outer screen and an inner production mandrel is suspended from a locking mandrel which is received in interlocking engagement within the bore of the landing nipple. The landing nipple is suspended from the lower end of the packer mandrel, and the sand screen is enclosed within the bore of a sliding side valve. This arrangement is useful in multiple production zone completions, with the sliding side valve being opened and closed as desired for selectively admitting production in various producing zones, or for isolation of a damaged screen.

In a third embodiment, a conventional wire-wrap sand screen is suspended from a landing nipple, with the annulus being sealed above and below a producing zone by packers. In the event the conventional wire-wrap screen should become damaged by said erosion or corrosion, rather than replacing the screen, a sand screen having a sintered, substantially spherical plastic bead prepack body sandwiched between an outer screen and an inner production mandrel is run into the bore of the conventional wire-wrap screen. The sand screen is suspended from the landing nipple by a releasable lock mandrel. The sand screen is thus interposed in the flow path for screening out sand fines which are conducted through the damaged conventional wire-wrap screen.

In yet another embodiment, a sand screen having a sintered, substantially spherical plastic bead prepack body sandwiched between an outer screen and an inner production mandrel is fitted about the mandrel of a sliding side valve circulation tool. Flow from the well is conducted through the sand screen and flows into the production tubing via the ports in the sliding side valve. The sliding side valve circulation tool may be opened and closed in both single and multizone completions for production control purposes, or for isolation of a damaged screen.

According to another embodiment, a sand screen having a sintered, substantially spherical plastic bead prepack body sandwiched between an outer screen and an inner production mandrel is suspended from a hanger packer in a through-tubing completion.

Other features and advantages of the present invention will be appreciated by those skilled in the art upon reading the detailed description which follows with reference to the attached drawings.

DETAILED DESCRIPTION OF THE PREFERRED EMBODIMENTS

Figure 1:
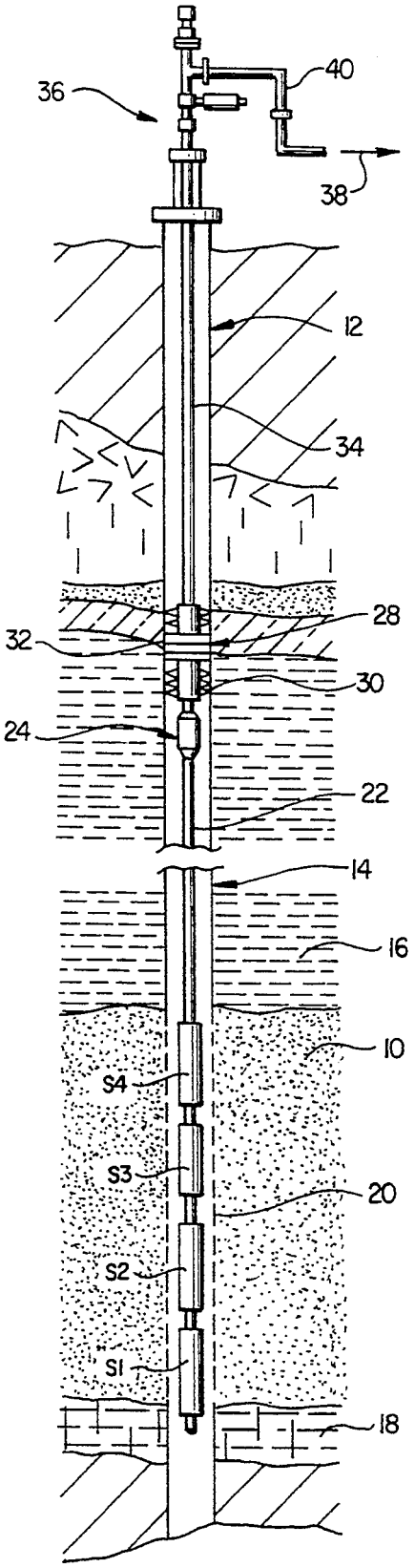
FIG. 1 is a simplified, schematic diagram showing a vertical section through a hydrocarbon formation which is intersected by a production well which has been completed with a sand screen having a sintered, substantially spherical plastic bead prepack body sandwiched between an outer screen and an inner production mandrel which is releasably suspended from a packer according to the teachings of the present invention.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, a hydrocarbon formation 10 is intersected by a production well 12. A tubular string of well casing 14 extends through multiple layers of overburden 16, traversing the hydrocarbon formation 10, and intersecting one or more layers of underburden 18. The tubular casing sections 14 which intersect the hydrocarbon Formation 10 are perforated by multiple openings 20 formed through the casing sidewall to permit inflow of formation fluids from the adjoining hydrocarbon bearing formation 10.

The hydrocarbon formation 10 is confined vertically between the overburden layer 16 and the underburden layer 18, typically of an impervious siltstone or other barren rock. The sand screen assembly of the present invention is particularly well adapted to a generally horizontally aligned hydrocarbon formation, such as the formation 10 as illustrated, having a thickness ranging from about 100 feet to about 500 feet. For illustrative purposes, the hydrocarbon formation 10 is described at a depth of 7,500 feet, with a reservoir pressure of 2,000 psi and a reservoir temperature of 130 degrees F. The overburden layer 16 and the subjacent underburden layer 18 are impervious to the flow of gas.

Figure 2:
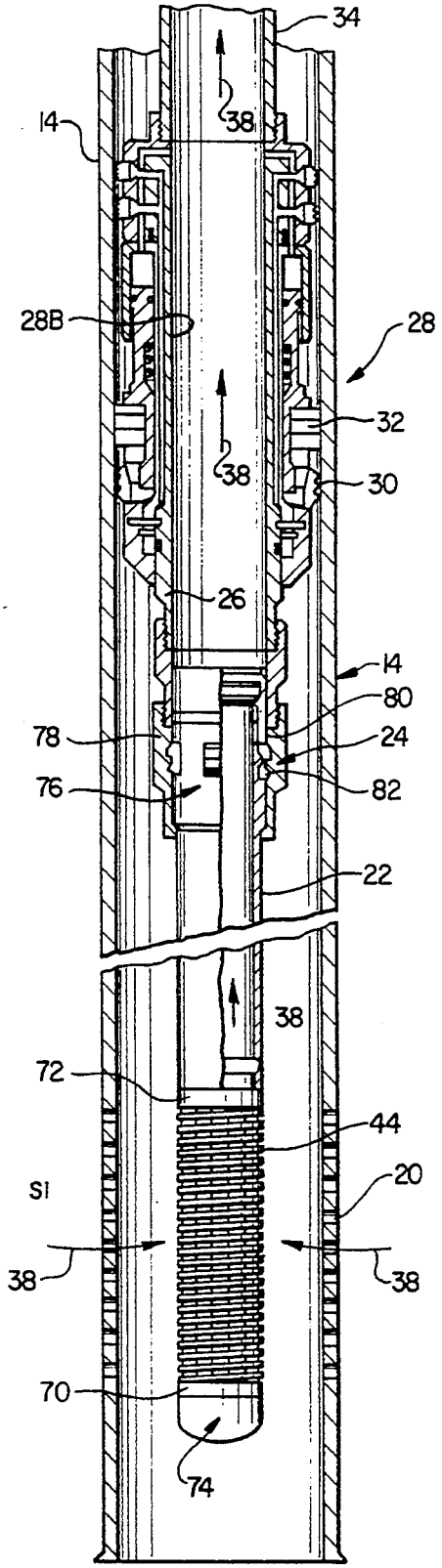
FIG. 2 is a simplified, sectional view which illustrates the releasable attachment of a sand screen having a sintered, substantially spherical plastic bead prepack body sandwiched between an outer screen and an inner production mandrel to the lower end of a packer mandrel.

Referring now to FIGS. 1 and 2, the production well 12 is completed by multiple screens S1, S2, S3, S4 which are supported by a lower tubing string 22. The lower tubing string 22 is suspended from landing nipple 24 attached to the mandrel 26 of a production packer 28. The production packer 28 includes anchor slips 30 and an elastomeric seal 32 which releasably secure and seal the packer against the bore of the tubular well casing 14. Formation fluid produced through the screens S1–S4 and the production tubing 22 flows to the surface through an upper tubing string 34 to a wellhead assembly 36. The wellhead assembly 36 supports the upper end of the production tubing string 34 and seals the casing 14. Formation fluid is conveyed in the direction of arrow 38 to a surface reservoir through the tubing strings 32, 34 and through a production flow line 40.

Figure 10:
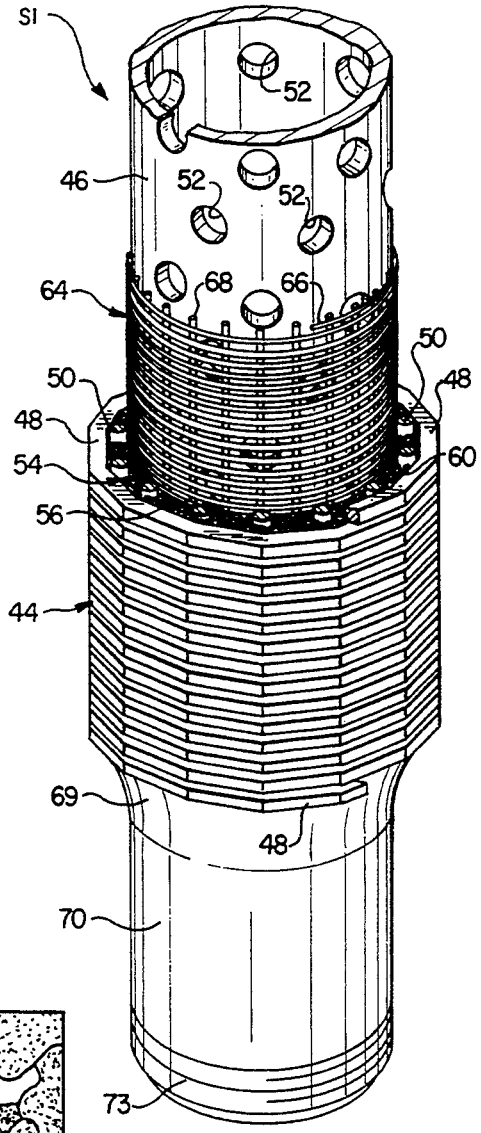
FIG. 10 is a perspective view, shown partially broken away, of a sand screen having a sintered, substantially spherical plastic bead prepack body sandwiched between an outer screen and an inner production mandrel.

Referring to FIG. 10, the sand screens S1, S2, S3 and S4 have substantially identical construction, each having a tubular screen body which includes a plurality of sintered, substantially spherical plastic members or beads 60, as described hereafter, that are sandwiched between an outer tubular screen 44 and a tubular, inner perforated production mandrel 46. As illustrated, the outer screen 44 may comprise an outer screen wire 48 which is wrapped in multiple turns onto longitudinally extending outer ribs 50, preferably in a helical wrap. The turns of the outer screen wire 48 are longitudinally spaced apart from each other to define flow apertures for conducting formation fluid flow while excluding sand and other unconsolidated formation material of a predetermined size.

The mandrel 46 is perforated by radial bore flow passages 52 which may follow parallel spiral paths along the length of the mandrel 46. The bore flow passages 52 provide for fluid flow through the mandrel 46 to the extent permitted by the external screen 44, the porous prepack body 54, described hereafter. The bore flow passages 52 may be arranged in any desired pattern and may vary in number in accordance with the area needed to accommodate the expected formation fluid flow through the production tubing 22, 34. Alternately, in another embodiment not shown in the Figs., the production mandrel may comprise an inner screen, similar to the inner screen 64 hereafter described. This embodiment is most useful where the strength of the solid production mandrel is not needed.

The outer screen 44 is spaced radially outward from the production mandrel 46 to define a prepack annulus 56, in which the prepack body 54 is disposed. The prepack body 54 is thus stabilized between the inner production mandrel 46 and the outer screen 44. The prepack body 54 comprises a permeable body of chemically inert to oil and gas fluids, acid resistant substantially spherical plastic members or beads 60, which are heated or sintered until they fuse and bond to each other and form a unitary, homogeneous body having a uniform pore size. Each of the spherical plastic beads 60 has a similar predetermined diameter such as 25 or 65 millimeters, with the larger diameter bead producing a more permeable sintered body with a larger pore size.

Each of the spherical plastic beads 60 is a plastic which is insoluble in 15% hydrochloric acid, and which is bonded together by sintering to form a homogenous mass to provide a uniform pore size. Suitable acid resistant plastic materials for forming the spherical plastic beads 60 are those comprising a resin selected from the group consisting of a polymer or copolymer of acrylic acid, methacrylic acid, esters of such acids and acrylonitrile; polyester; urea-formaldehyde; melamine-formaldehyde; and styrene-divinylbenzene. Copolymers of styrene-divinylbenzene resin are available from Dow Chemical Company, and are available in spherical bead form from Sun Drilling Products Corporation. The spherical plastic beads 60 are thus resistant to contact with formation fluids having a pH of from about 6 to about 12, as well as corrosive formation fluids containing sulfurous compounds such as hydrogen sulfide or sulphur dioxide in concentrations up to about 20 g by weight.

Because of the perfect roundness of the beads 60, non-interlocked beads offer almost no resistance to the passage of objects in comparison to conventional aggregate material such as sand wherein the slight angularity of the aggregate causes surfaces to engage at angles to provide some resistance to the passage of objects through the aggregate. The lack of resistance offered by non-interlocked beads can be demonstrated by filling a cup with spherical plastic beads, through which a pencil may easily be pushed to the bottom of the cup. The "lubricity" or "ball-bearing" effect of spherical beads is why both glass and styrene-divinylbenzene beads have found success in the drilling, extended bit life, field. Such lubricity is disclosed in U.S. Pat. No. 4,063,603, which discloses a method in which spherical plastic beads are added to a drilling mud to provide lubrication to reduce torque and drag on the drill string to smooth drilling operations downhole. However, interlocking the beads 60 together by sintering or heating the beads until the fuse and bond as provided by the present invention acts to restrain differential pressure channeling, as well as channeling due to erosion failure of the outer screen 42.

The beads 60 may be bonded together by sintering or heating the beads 60 for about one hour to about two hours at a temperature of approximately 450 degrees Fahrenheit to about 525 degrees Fahrenheit. Depending on the particular dimensions of the embodiment and any time necessary to conduct heat through the outer screen 44, the inner screen 64 and the mandrel 46, styrene-divinylbenzene may be bonded together by heating the beads for about one hour at a temperature of about 475 degrees Fahrenheit. The heating causes the spherical beads 60 to fuse to each other at their contacting surfaces and interlock, thus providing a sintered, homogeneous permeable body 54. Preferably, heating will occur at a temperature less than 1000 degrees Fahrenheit until the beads 60 fuse to each other and form an interlocked body, but without a substantial alteration in the spherical shape of the beads occurring, thus providing a uniform pore space 62 as discussed hereafter. Because of the high closure (granular) strength of styrene-divinylbenzene, i.e. 20,000 p.s.i., the interlocked body 54 provided by sintering the beads 60 until they fuse together and interlock is resistant to differential pressure channelling, as well as channelling resulting from erosion failure of the outer screen 44.

Styrene-divinylbenzene is a ductile material. Thus, when the beads 60 are sintered or heated until the beads 60 interlock into a homogeneous body, the interlocked body 54 is ductile, and therefore resistant to cracking under normal bending stress encountered during handling and while running the well screen to depth. Cracking can lead to high entrance velocity passages which in turn can cause catastrophic erosion damage. Thus, the well screen of the present invention is capable of withstanding rough run-in handling, and the effects of cracking caused by normal bending stress is avoided. In contrast, the resin link cementing together conventional resin coated silica provides little ductility, and conventional prepacks of resin coated silica are highly susceptible to cracking from bending forces encountered during rough handling, shipping and running the resin coated prepack in deviated well bores.

Figure 11:
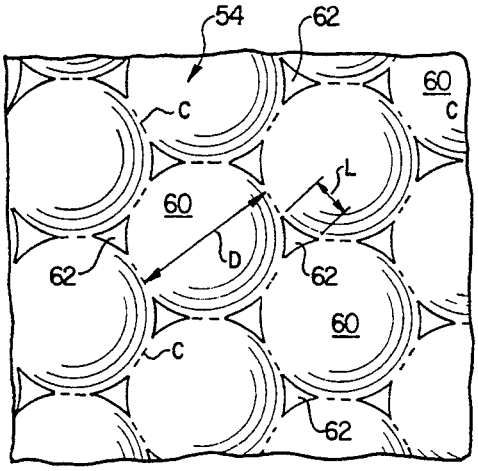
FIG. 11 is a greatly enlarged pictorial representation of a microscopic section taken through an external surface region of the sintered, substantially spherical plastic bead prepack body of FIG. 10; and, FIG. 12 is a greatly enlarged pictorial representation of a microscopic section taken through an external surface region of conventional, irregularly shaped aggregate.
Figure 12:
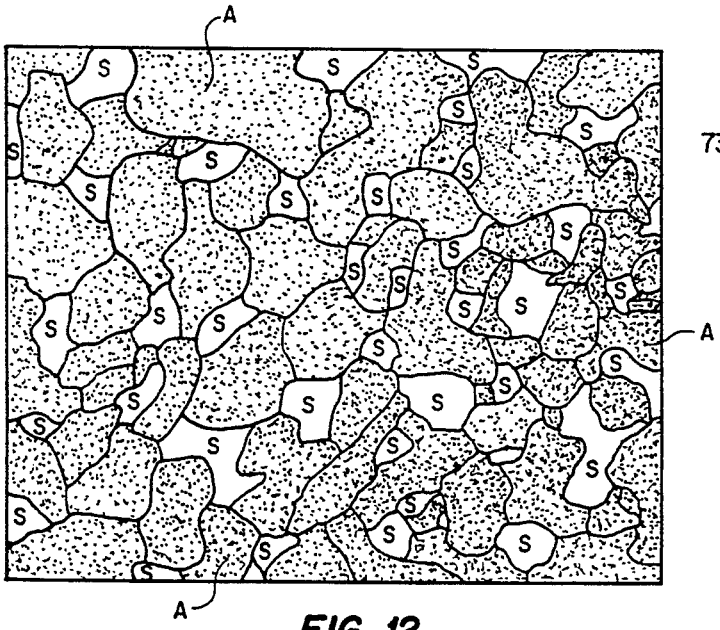

As shown in detail in FIG. 11, the pore space 62 between beads 60 having a constant diameter D are similarly sized, thus a uniform pore size L is provided. As shown in detail in FIG. 12, the matrix pore size S of irregularly shaped aggregate material A varies, and only an average pore size can be predicted, which allows for the passage of fines which are larger than the average pore size. However, as shown in detail in FIG. 11, the sintered, spherical beads 60 of the present invention provide a homogeneous, permeable body 54 having a uniform pore size L, which is related directly to the diameter D of the bead. Passage of fines larger than the uniform pore size L is thus uniformly restricted, and the size of the particulate matter to be screened out can be predicted as a function of the bead size D. Consequently, based on nearby experience with unconsolidated sands, the bead size diameter D can be chosen so that the expected particulate matter size can be effectively filtered out of the tonnation fluid. Because the beads 60 are sintered until they bond at their contacting points C into a homogeneous body, channelling is restrained and the sintered body forms a barrier to prevent the passage or particulate matter of a predetermined size.

Vibration may be used to pack the beads 60 into a void free body (applicants however wish to point out that the sense of the meaning in which void is used in the application does not mean pore size). Because of the angularity of the conventional resin and non-resin sands, the use of vibration and gravity may fail to place angular aggregate material in a void free body, which allows for channeling to occur. This eventually leads to an erosive cut leakage path through the screen and generally yields a catastrophic failure. However, due to the round, ball bearing effect of the spherical plastic members, the spherical plastic members form a void-free body, even in narrowly dimensioned prepack annulus arrangements when packed together. Thus, when the plastic beads 60 are sintered until they bond together, a homogeneous void-free permeable body 54 is provided.

Referring again to FIG. 10 for details, the prepack body 54 may be formed as follows. Once the outer screen 44 is assembled around the inner production mandrel 46, the beads 60 are loaded into the prepack annulus 56 and the prepack annulus 56 sealed by suitable means such as an annular weld 69, thus trapping the divinylbenzene beads 60 within the prepack annulus 56. As may be appreciated, the annulus 56 formed between the outer screen 44 and the inner screen 64, forms a mold in which the beads 60 may be sintered in place. The divinylbenzene beads 60 may be bonded together within the annulus by sintering or heating the beads 60 as described in the foregoing. The heating causes the spherical beads 60 to fuse or bond to each other at their contacting surfaces and interlock, thus providing a sintered, homogeneous permeable prepack body 54.

As illustrated, an inner screen 64 may be provided between the inner production mandrel 46 and the prepack body 54. The inner screen 64 may include a narrow gauge stainless steel wire 66 which is wrapped onto longitudinally extending inner ribs 68, preferably in a helical wrap. Similarly to the turns of the outer screen wire 48, the turns of the inner screen wire 66 are axially spaced apart form each other to provide fluid flow passages for conducting formation fluid while excluding sand fines. Preferably, the outer and inner screen wires 48 and 66, the outer and inner ribs 50 and 68 are formed of stainless steel or other weldable material and are joined together by resistance welds at each crossing point, and at junctures with the production mandrel 46. Annular welds 69 at opposite ends portions of outer screen 44 join the outer screen 44 to the mandrel 46 and enclose the prepack annulus 56.

Referring to FIGS. 2 and 10, the screen S1 has tubular end portions 70, 72 which may be fitted with threaded connections 73 for attachment to the production robing 22 on the upper end, and for attachment to a bull plug 74 on the lower end. The bull plug 74 seals the lower end of the sand screen bore, thus constraining the formation fluid to flow in the direction of arrows 38 through the outer screen 44, the sintered, spherical plastic prepack 54, the inner screen 64, if present, and through the perforated mandrel 46 and upwardly through the production bores of the robing 22 and robing 34.

It will be appreciated that the sand screens S1, S2, S3 and S4 may become damaged over the passage of time. Accordingly, it may be necessary to repair or replace the sand screens from time to time. According to an important feature of the present invention, the sand screens are releasably suspended from the packer 28 by a locking mandrel 76 which is disposed in releasable, interlocking engagement with the landing nipple 24. In this arrangement, the landing nipple 24 is attached to the lower end of the packer mandrel 26. The landing nipple 24 has a tubular mandrel 78 which is intersected by a longitudinal bore 80 which is connected in flow communication with the packer mandrel bore 28B. The landing nipple mandrel 78 is radially intersected by an internal annular slot 82 for receiving a radially deflectable locking key 84 carried by the locking mandrel 76. As can be seen in FIG. 2, the locking mandrel 76 is received in releasable, interlocking engagement with the landing nipple 24. The lower tubing string 22 is attached to the locking mandrel 76, thus suspending the sand screens S1, S2, S3 and S4 at the appropriate depth corresponding with the production zone 10.

The sand screens S1–S4, the lower tubing string 22 and the locking mandrel are retrievable with the assistance of a running tool which is insertable into the bore of the locking mandrel 76. When the running tool engages the locking mandrel, locating dogs on the running tool engage and locate the lower end of a nipple hone bore. Further upward movement through the nipple results in the running tool causing an expander sleeve to move down, which offsets the bend in the bias springs. This causes the bias springs and the locking keys to move to the locating position. The locking keys flex from the locating position to the retracted position when being pulled across the nipple locator dogs. Thus, installation and retrieval of the sand screens can be carried out, without removing the packer.

Figure 3:
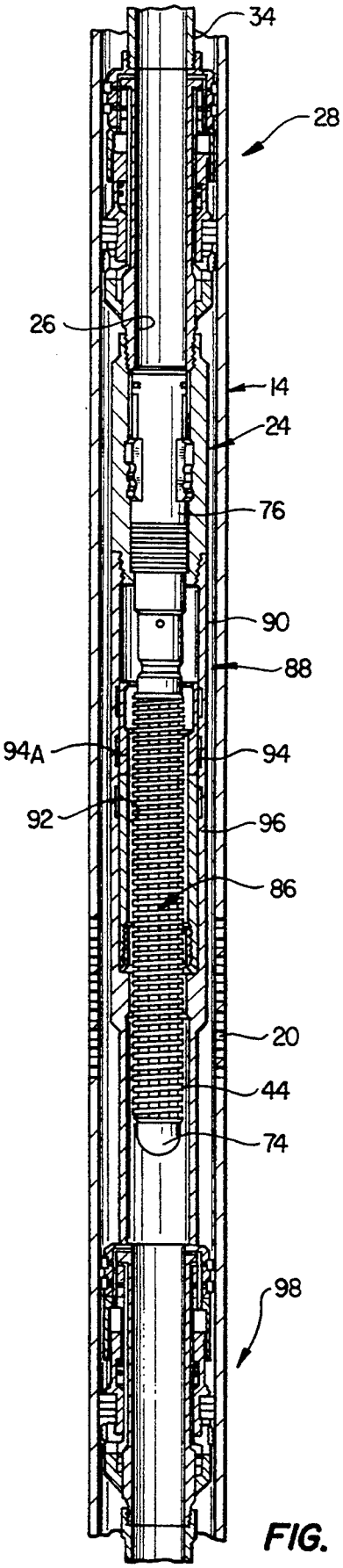
FIG. 3 Is a simplified, sectional view which illustrates the releasable installation of a sand screen having a sintered, substantially spherical plastic bead prepack body sandwiched between an outer screen and an inner production mandrel within the bore of a sliding side valve.

Referring now to FIG. 3, a sand screen 86 having a sintered, spherical plastic bead prepack body 54 sandwiched between an outer screen 44 and an inner production mandrel 46 is suspended from the locking mandrel 76. The landing nipple 24 is secured to the packer mandrel 26 and the sand screen 86 is suspended from the lower end of the locking mandrel 76, as previously discussed. In addition, the sand screen 86 is enclosed within the bore of a sliding side valve 88. The sliding side valve 88 is a circulation tool having a tubular mandrel 90 intersected by a longitudinal production bore 92 and having a sidewall portion radially intersected by a circulation port 94. A tubular sleeve 96 is slidably received within the bore of the circulation sub for opening and closing the circulation port 94. The, circulation sub mandrel 90 is connected at its upper end to the landing nipple 24, and at its lower end to a second production packer 98.

According to this arrangement, the first production packer 28 and the second production packer 98 isolate the annulus formed between the casing 14 and the lower production string 22 in the production zone 10. Formation fluid entering through the well casing perforations 20 flows through the flow port 94 of the circulation sub 62. Because the lower end of the sand screen 86 is sealed by the bull plug 74, the formation fluid is constrained to flow through outer screen 44, the sintered, spherical plastic bead prepack body 54, the inner screen 64 if present, and the perforated mandrel 46 upwardly through the bore of the first production packer 24. The sand screen 86 can be retrieved as previously discussed, and the sliding side door sleeve valve can be moved to the closed position, thereby blocking the flow port 94 and isolating the production zone, without removing the production packers 28, 98.

Figure 4:
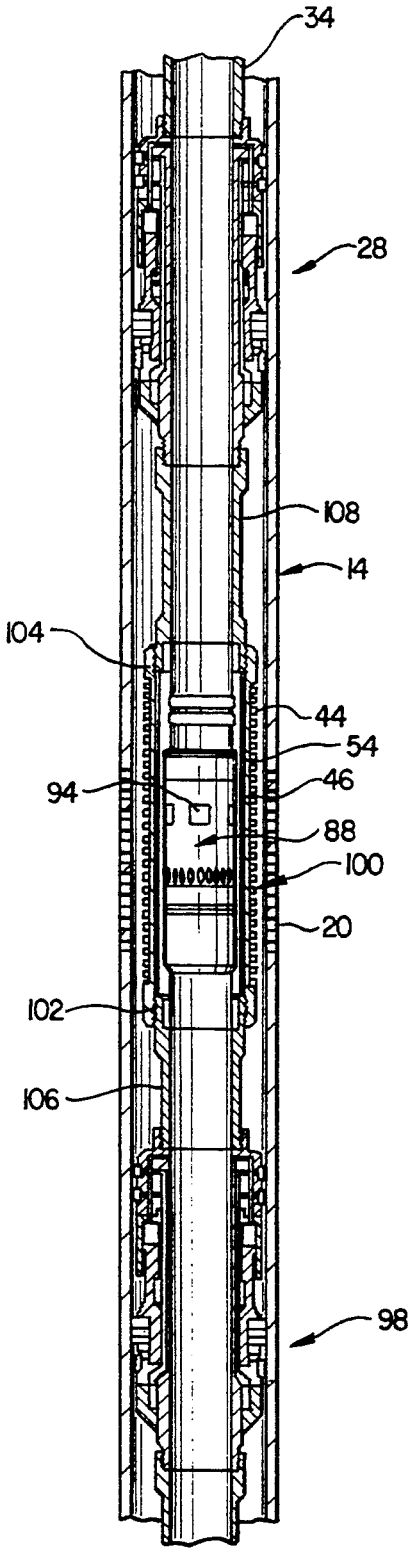
FIG. 4 is a simplified, sectional view which illustrates the assembly of a sliding side valve as the internal mandrel for a sand screen having a sintered, substantially spherical plastic bead prepack body sandwiched between an outer screen and an inner production mandrel.

Referring now to FIG. 4, a sand screen 100 having a sintered, spherical plastic bead prepack body 54 sandwiched between an outer screen 44 and an inner production mandrel 46 is fitted about the sliding side valve or circulation sub 88. The sand screen 100 has tubular end portions 102, 104 which are fitted with threaded connections for attachment to connecting subs 106, 108, respectively. The connecting subs 106, 108 connect the circulation sub 88 to the mandrel of the packer 28, and to the mandrel of the lower packer 98. The end collars 102, 104 are attached to the connecting subs by threaded fittings, or alternatively, by welds.

Figure 5:
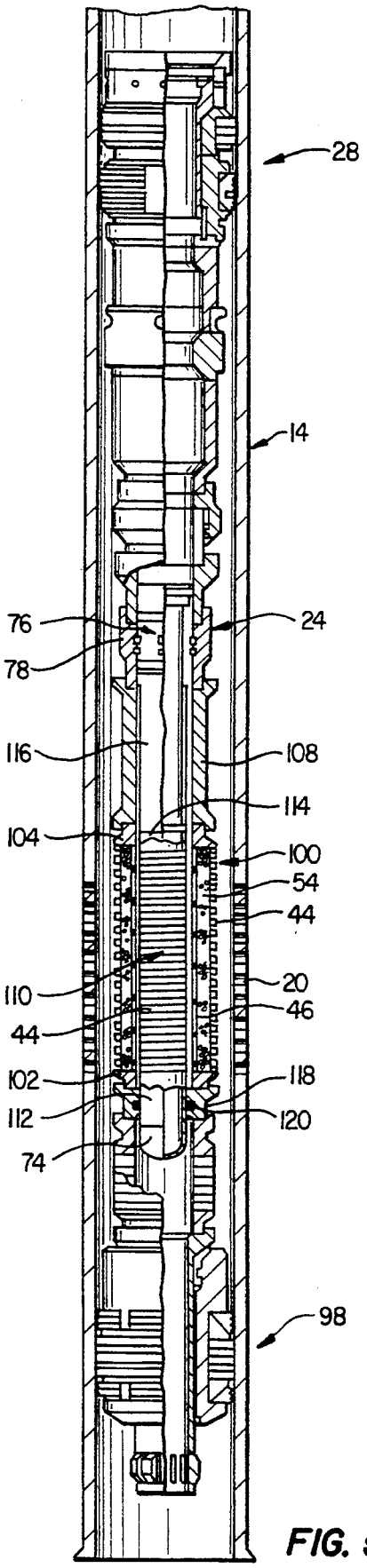
FIG. 5 is a simplified, sectional view which illustrates the installation of an auxiliary sand screen having a sintered, substantially spherical plastic bead prepack body sandwiched between an outer screen and an inner production mandrel within the bore of a primary sand screen.

Referring now to FIG. 5, the sand screen 100 is suspended from the landing nipple 24 by the connecting sub 108. In this embodiment, the sand screen 100 serves as a primary sand screen, and its operation is enhanced by an auxiliary sand screen 110 having a sintered, spherical plastic bead prepack body 54 sandwiched between an outer screen 44 and an inner production mandrel 46. In this arrangement, the well annulus in the production zone is isolated by the upper and lower production packers 28, 98 as previously discussed. Formation fluid enters through the well casing perforations 20 and is conducted through the outer screen 44, the sintered, spherical plastic bead prepack body 54, the inner screen 66 if present and the perforated mandrel 46 of the primary sand screen 100. If the primary screen 100 should become damaged, rather than replacing the screen 100, the auxiliary sand screen 110 is run into the bore of the primary screen as shown in FIG. 5. According to this arrangement, the auxiliary sand screen 110 is interposed in the flow path for screening out sand fines which are conducted through the damaged primary sand screen.

The lower end of the auxiliary sand screen 110 is sealed by a bull plug 74. The auxiliary sand screen 110 is provided with end collars 112, 114. The upper collar 114 is fitted with threads for attachment to a coupling sub 116. The lower coupling collar 112 has a polished external surface. The lower polished collar 112 is coupled in sealing engagement with a coupling collar 118 connected to the lower end of the auxiliary sand screen 110. The coupling collar 118 has a polished bore for receiving the polished external surface of the collar 112. The interface between the sealing collar 112 and the coupling collar 118 is sealed by an annular O-ring seal 120. According to this arrangement, formation fluid from below the lower production packer 98 is blocked, and only formation fluid entering through the well casing perforations 20 in the production zone enter through the sand screen 100.

Figure 6:
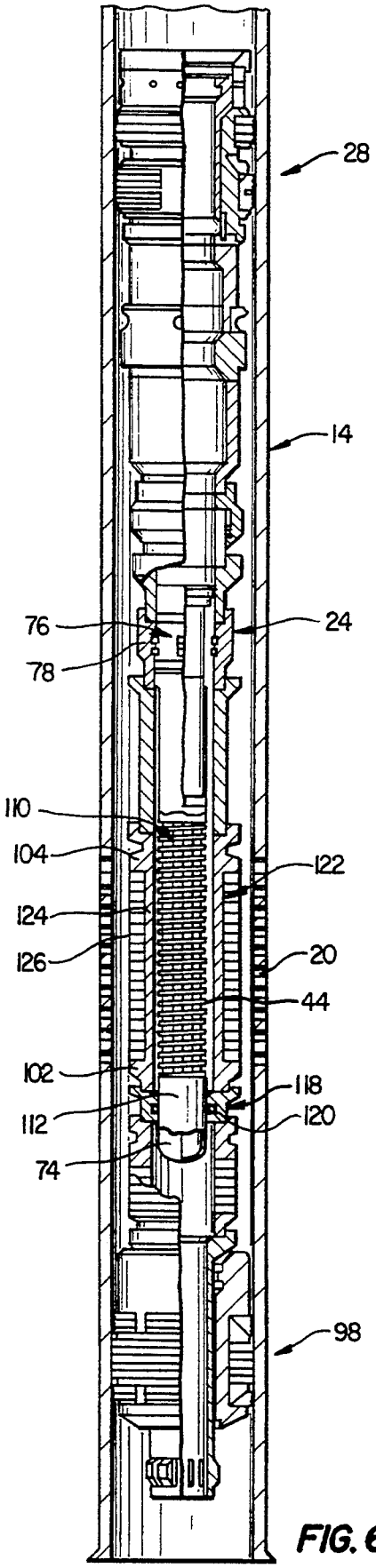
FIG. 6 is a view similar to FIG. 5 which illustrates the releasable installation of a sand screen having a sintered, substantially spherical plastic bead prepack body sandwiched between an outer screen and an inner production mandrel within a conventional wire-wrap screen.

Referring now to FIG. 6, a similar installation is disclosed in which the primary sand screen is a conventional wire-wrap screen 122. The primary sand screen 122 has a perforated inner mandrel 124 and a screen wire 126 wrapped in a helical path externally about the perforated mandrel, thereby defining longitudinally spaced, outer screen apertures for conducting formation fluid through the primary screen. Should the primary screen 122 be damaged by corrosion or erosion, the auxiliary sand screen 110 is run into its bore, thereby intercepting sand fines which are conducted through the damaged portions of the primary screen. Accordingly, production can be continued from the producing zone without replacing the damaged primary screen.

Figure 7:
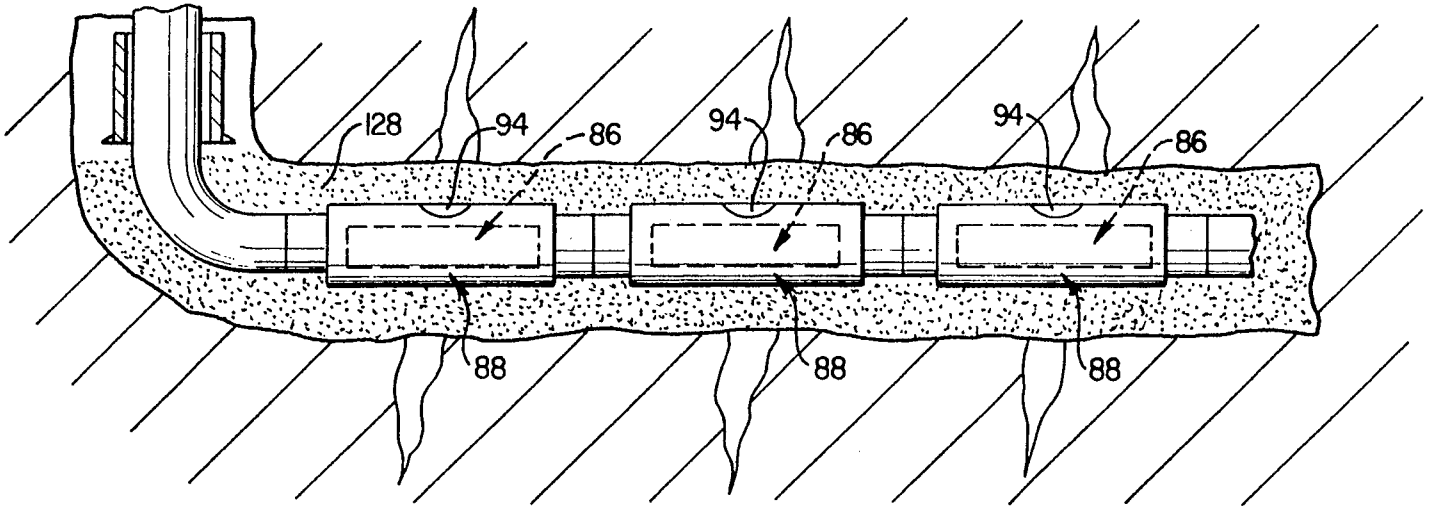
FIG. 7 is a simplified, sectional view which illustrates a horizontal well completion in an uncased bore hole, in which a section of sand screen having a sintered, substantially spherical plastic bead prepack body sandwiched between an outer screen and an inner production mandrel is enclosed within the bore of a sliding side valve.

Referring now to FIG. 7, multiple sand screens 86, each having a sintered, spherical plastic bead prepack body 54 sandwiched between an outer screen 44 and an inner production mandrel 46, are shown enclosed within circulation sub 88 which are connected in a series configuration within a horizontal well completion in an uncased well bore 128. Because of the porosity and large surface area provided by the sand screens 86, they are well adapted for use in horizontal completions in which the producing formation is characterized by relatively low entrance velocity of formation fluid.

Figure 8:
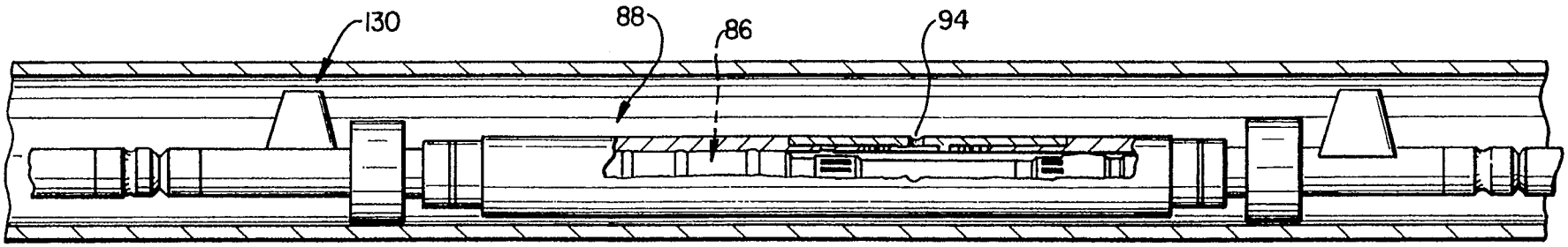
FIG. 8 is a simplified, sectional view which illustrates a horizontal well completion in a cased bore hole, in which a section of sand screen having a sintered, substantially spherical plastic bead prepack body sandwiched between an outer screen and an inner production mandrel is enclosed within the bore of a sliding side valve.

A similar horizontal completion is illustrated in FIG. 8, in which the bore hole is reinforced by a horizontal casing. In this arrangement, the circulation sub 88 is positioned by an orienting tool 130, as disclosed in U.S. Pat. No. 5,107,927, assigned to Otis Engineering Corporation, and incorporated herein by reference.

Figure 9:
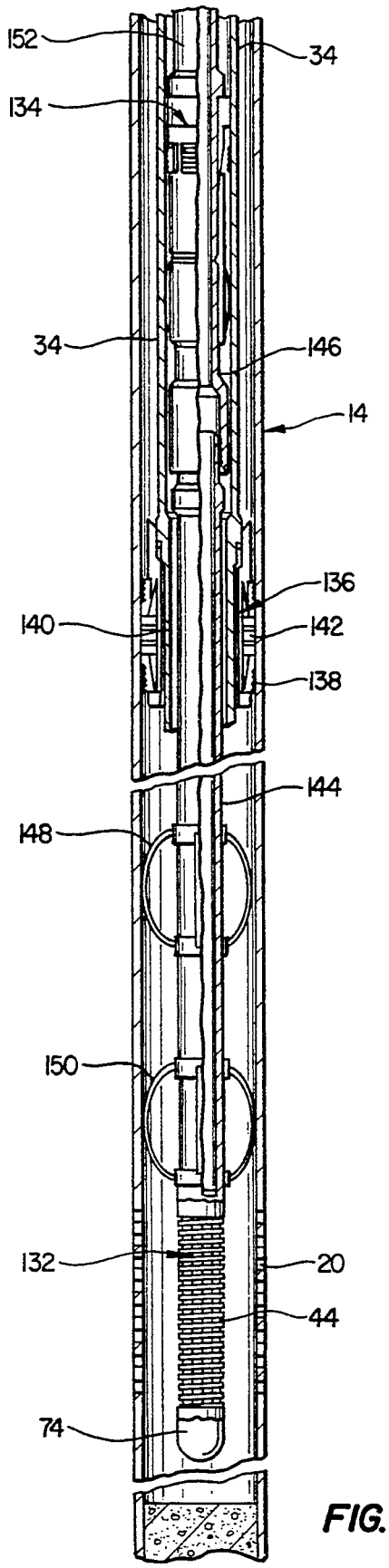
FIG. 9 is a simplified, sectional view which illustrates installation of a sand screen assembly having a sintered, substantially spherical plastic bead prepack body sandwiched between an outer screen and an inner production mandrel where support is provided by a hanger packer in a through-tubing completion.

Referring now to FIG. 9, a sand screen 132 having a sintered, spherical plastic bead prepack body 54 sandwiched between an outer screen 44 and an inner production mandrel 46 is suspended from a hanger packer 134 in a through-tubing completion. Such completions may be used, for example, in offshore installations, in which it is desirable that the tubing weight be transferred to the casing 14 below the mud line. It is also intended for installations where it is desirable to retrieve and reinstall tubing removable safety valves without disturbing the production tubing or the downhole production packer.

In the through-tubing embodiment of FIG. 9, the upper production tubing string 34 is stabbed and sealed against the mandrel bore of a production packer 136. The production packer 136 is equipped with anchor slips 138 which are movably mounted on a tubular body mandrel 140 for radial expansion into set engagement against the well casing 14. The production packer 136 is also equipped with annular seal elements 142 which are expandable into sealing engagement against the well casing 14.

The sand screen 132 is coupled to the hanger packer 134 by a tubular extension sub 144 and an overshot tubing seal divider 146. The sand screen 132 and the extension sub 144 are centered within the bore of the well casing 14 by bow spring centralizers 148, 150. The hanger packer 134, tubular extension sub 144, and the sand screen 132 may be suspended within the upper production tubing 34 by various means, including a braided line, reeled tubing or, as shown in this exemplary embodiment, a jointed string of auxiliary production tubing 152. The auxiliary production tubing string 152 is concentrically disposed within the upper production tubing string 34, and is releasably attached to the wellhead 36 at the surface.

The through-tubing installation shown in FIG. 9 permits most of the tubing weight of the sand screen assembly, extension sub, and hanger packer to be transferred to the casing below the mud line, or at some other predetermined point downhole where the well casing has good lateral support. The hanger packer 134 is designed for release from the well casing with a straight upward pull, so that the sand screen 132 may be retrieved to the surface for replacement, without disturbing the production packer 136 or the primary production tubing 34.

The invention has been described with reference to certain exemplary embodiments, and in connection with vertical as well as horizontal well completions. Various modifications of the disclosed embodiments as well as alternative well completion applications of the invention will be suggested to persons skilled in the an by the foregoing specification and illustrations. It is therefore contemplated that the appended claims will cover any such modifications or embodiments which fall within the true scope of the invention.

What is claimed is:

1. Well completion apparatus comprising, in combination:

a packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and a well casing in the radially expanded, set condition;

a landing nipple attached to said packer body mandrel, said landing nipple having tubular mandrel intersected by a longitudinal bore disposed in flow communication with said packer mandrel bore;

a locking mandrel disposed in releasable interlocking engagement with said landing nipple, said locking mandrel being intersected by a longitudinal bore defining a flow passage in flow communication with said packer mandrel bore; and, a sand screen coupled to said locking mandrel, said sand screen including;

a tubular mandrel having a bore defining a production flow passage, said mandrel being radially intersected by at least one flow aperture communicating with said flow passage, a plurality of sintered, spherical plastic members along at least a portion of said mandrel covering said flow aperture; and a circulation sub having a tubular mandrel intersected by a radial circulation port and by a longitudinal bore defining a flow passage, and having a tubular sleeve mounted within the bore of said circulation mandrel for opening and closing the circulation port, the mandrel of said circulation sub being suspended from said landing nipple, and said sand screen being concentrically disposed within the bore of said circulation sub.

2. Well completion apparatus comprising, in combination:

a first packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and a well casing in the radially expanded, set condition;

a second packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and a well casing in the radially expanded, set condition;

a circulation sub having a tubular mandrel intersected by a longitudinal production bore and having a sidewall portion radially intersected by a circulation port, and having a tubular sleeve slidably received within the bore of said circulation sub for opening and closing the circulation port, the mandrel of said circulation sub being coupled to the mandrels of said first and second packers, thereby defining a longitudinal flow passage therebetween; and, a sand screen mounted on said circulation sub, said sand screen having;

a tubular production mandrel disposed in radially spaced relation with respect to said circulation sub and having a bore defining a production flow passage, said production mandrel being radially intersected by at least one flow aperture communicating with said flow passage, and a plurality of sintered, substantially spherical plastic members along at least a portion of said production mandrel covering said flow aperture,

3. Well completion apparatus comprising, in combination:

a first packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and a well casing in the radially expanded, set condition;

a second packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and a well casing in the radially expanded, set condition;

a landing nipple coupled to the mandrel of said first packer, said landing nipple having a tubular mandrel intersected by a longitudinal bore disposed in flow communication with the mandrel bore of said first packer;

a locking mandrel disposed in releasable, interlocking engagement with said landing nipple, said locking mandrel being intersected by a longitudinal bore defining a flow passage disposed in flow communication with said packer mandrel bore;

a primary sand screen having a first tubular end portion coupled to the mandrel of said landing nipple and having a second tubular end portion coupled to the mandrel of said second packer, and having a fluid porous, particulate-restricting member extending between said first and second tubular end portions, said fluid porous, particulate-restricting member having a tubular bore defining a fluid flow passage;

an auxiliary sand screen received within the production bore of said primary sand screen, said auxiliary sand screen having:

a tubular production mandrel disposed in radially spaced relation to said primary sand screen and having a bore defining a production flow passage, said production mandrel being radially intersected by at least one flow aperture communicating with said flow passage, and a plurality of sintered, spherical plastic members along at least a portion of said production mandrel covering said flow aperture; and, sealing means coupled to said primary sand screen and to said auxiliary sand screen for sealing the annulus between said primary and secondary sand screens, and for sealing the longitudinal flow passage on the lower end of said auxiliary sand screen.

4. Well completion apparatus as defined in claim 3, wherein said primary sand screen comprises;

a tubular mandrel having a bore defining a production flow passage, said production mandrel being radially intersected by at least one flow aperture communicating with said flow passage, and a plurality of sintered, spherical plastic members along at least a portion of said mandrel covering said flow aperture.

5. Well completion apparatus as defined in claim 3, wherein said primary sand screen comprise a perforated mandrel and an wire screen mounted on said mandrel, said wire screen having a screen wire wrapped externally about said perforated mandrel, thereby defining longitudinally spaced outer screen apertures for conducting formation fluid through said primary screen.

6. Well completion apparatus as defined in claim& including a coupling collar disposed intermediate said primary sand screen and the mandrel of said second packer, said coupling collar having a polished bore, and further including annular seal means disposed between the polished bore and the auxiliary screen mandrel.

7. Well completion apparatus as defined in claim 3, said auxiliary sand screen including a plug attached to the lower end of said tubular production mandrel for sealing the longitudinal flow passage of said auxiliary sand screen.

8. An improved sand screen assembly for separating particulate material from formation fluid comprising, in combination:

a first packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and a well casing in the radially expanded, set condition;

a second packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and a well casing in the radially expanded, set condition;

a primary sand screen having a first tubular end portion coupled to the mandrel of the first packer and having a second tubular end portion coupled to the mandrel of the second packer, said primary sand screen having a fluid porous, particulate-restricting member extending between said first and second tubular end portions, said fluid porous, particulate-restricting member having a tubular bore defining a fluid flow passage;

an auxiliary sand screen received within the production bore of said primary sand screen, said auxiliary sand screen having:

a tubular production mandrel having a bore defining a production flow passage in flow communication with the mandrel bore of said first packer, said production mandrel being radially intersected by at least one flow aperture communicating with said flow passage, and a plurality of sintered, spherical plastic members along at least a portion of said production mandrel covering said flow aperture; and, sealing means coupled to said primary sand screen and to said auxiliary sand screen for sealing the annulus between said primary and secondary sand screens, and for sealing the longitudinal flow passage on the lower end of said auxiliary sand screen.

9. An improved sand screen assembly as defined in claim 8, wherein said primary sand screen comprises:

a tubular mandrel having a bore defining a production flow passage, said production mandrel being radially intersected by at least one flow aperture communicating with said flow passage, and a plurality of sintered, spherical plastic members along at least a portion of said mandrel covering said flow aperture.

10. An improved sand screen assembly as defined in claim 8, wherein said primary sand screen comprises a perforated mandrel and a wire screen mounted on said mandrel, said wire screen having a screen wire wrapped externally about said perforated mandrel, thereby defining longitudinally spaced, outer screen apertures for conducting formation fluid through said primary screen.

11. An improved sand screen assembly as defined in claim 8, including a coupling collar disposed intermediate the primary sand screen and the mandrel of said second packer, said coupling collar having a polished bore, and further including annular seal means disposed between the polished bore and the auxiliary screen mandrel.

12. An improved sand screen assembly as defined in claim 8, said auxiliary sand screen including a plug attached to the lower end of said tubular, porous body for sealing the longitudinal flow passage of said auxiliary sand screen.

13. Apparatus for completing a well of the type having a well casing extending between a subterranean production zone and a surface wellhead assembly comprising, in combination:

a first packer including a body mandrel having a longitudinal bore defining a production flow passage, anchor slips movably mounted on said packer body mandrel for radial expansion into set engagement against the well casing, and an annular seal element mounted on said body mandrel for radial expansion into set engagement against the well casing, thereby providing an annular fluid seal across the annulus between the body mandrel and the well casing in the radially expanded, set condition;

a first production tubing string having a first end portion coupled to the body mandrel of said first packer and having a second end portion adapted for attachment to the wellhead assembly;

a second packer disposed with the bore of the first production tubing string, said second packer including a body mandrel having a longitudinal bore defining a production flow passage, anchor slips movably mounted on the body mandrel of said second packer for radial expansion into set engagement against the sidewall of the first production tubing string, and an annular seal element mounted on said body mandrel for radial expansion into set engagement against the sidewall of the first production tubing string, thereby providing an annular fluid seal across the annulus between the body mandrel and said first production tubing string in the radially expanded, set condition;

a second production tubing string having a first end portion coupled to the body mandrel of said second packer and having a second end portion adapted for attachment to the wellhead assembly;

a third production tubing string having a first end portion projecting through the body mandrel bore of said first packer and coupled to the body mandrel of the second packer, and having a second end portion suspended within the well casing intermediate the first packer and the production zone; and, a sand screen coupled to the second end portion of the third production tubing string, said sand screen having:

a tubular production mandrel having a bore defining a production flow passage disposed in flow communication with the body mandrel bore of the second packer, said production mandrel being radially intersected by at least one flow aperture communicating with said flow passage, and a plurality of sintered, spherical plastic members along at least a portion of said production mandrel covering said flow aperture.

14. A well completion apparatus comprising:

a packer including a body mandrel having a longitudinal bore defining a production flow passage, anchor slips movably mounted on said packer body mandrel for radial expansion into set engagement against a well casing, and an annular seal element mounted on said body mandrel for radial expansion into set engagement against a well casing, thereby providing an annular fluid seal across the annulus between the body mandrel and the well casing;

a circulation sub having a tubular mandrel intersected by a longitudinal production bore and having a sidewall portion radially intersected by a circulation port, and having a tubular sleeve slidably received within the bore of said circulation sub for opening and closing the circulation port; and a sand screen concentrically connected to said circulation sub, said sand screen including:

a tubular mandrel having a bore defining a production flow passage, said mandrel being radially intersected by at least one flow aperture communicating with said flow passage, and a plurality of sintered, spherical plastic members along at least a portion of said mandrel covering said flow aperture.

15. The well completion apparatus as recited in claim 14, wherein said sand screen includes a plug attached to the lower end of said tubular mandrel for sealing the longitudinal flow passage of said sand screen.

* * * * *